United States Patent [19]

Koga et al.

[11] Patent Number: 4,610,315

[45] Date of Patent: Sep. 9, 1986

[54] PIPE HANDLING APPARATUS FOR OIL DRILLING OPERATIONS

[75] Inventors: Minoru Koga; Toshio Kizawa; Toshio Hirose, all of Tokyo, Japan

[73] Assignee: Ishikawajima-Harima Jukogyo Kabushiki Kaisha, Tokyo, Japan

[21] Appl. No.: 712,642

[22] Filed: Mar. 18, 1985

[30] Foreign Application Priority Data

Apr. 27, 1984 [JP] Japan ..... 59-83969

[51] Int. Cl.[4] ..... E21B 19/20

[52] U.S. Cl. ..... 175/85; 175/52; 175/203; 166/77.5; 414/22

[58] Field of Search ..... 175/52, 85, 161, 202, 175/203; 166/77.5; 414/22; 173/164

[56] References Cited

U.S. PATENT DOCUMENTS 3,768,663 10/1973 Turner, Jr. et al. ..... 175/85 X
4,042,123 8/1977 Sheldon et al. ..... 175/85 X
4,187,546 2/1980 Hefferman et al. ..... 175/52 X
4,235,566 11/1980 Beeman et al. ..... 175/85 X

FOREIGN PATENT DOCUMENTS 1151144 8/1983 Canada ..... 175/85

*Primary Examiner*—Stephen J. Novosad
*Assistant Examiner*—John F. Letchford

[57] ABSTRACT

This invention relates to a pipe handling apparatus for oil drilling operations, which is designed so as to handle simply without errors the pipes used for oil drilling operations, and which is provided with a pipe transfer unit for transferring a pipe mechanically between a pipe storage space and the oil well center, a pipe lift unit capable of lowering a pipe, which has been carried to the oil well center by the pipe transfer unit, thereinto and withdrawing a pipe from the oil well center, and a pipe transfer unit for transferring a pipe, which has been withdrawn from the oil well center by the pipe lift unit, to a pipe rack unit automatically so as to store the pipe therein.

2 Claims, 11 Drawing Figures

PIPE HANDLING APPARATUS FOR OIL DRILLING OPERATIONS

BACKGROUND OF THE INVENTION

This invention relates to a pipe handling apparatus for oil drilling operations and earth drilling operations, and more particularly to a pipe handling apparatus which is capable of mechanically carrying out the transportation of short pipes between a pipe storage rack and the oil well center, pipe lifting and lowering operations and the storage and transportation of stand pipes, and thereby improving the safety of a pipe handling operation and the oil productivity.

To drill a submarine oil well, a floating or seafloor-set marine structure is generally used. On this marine structure, a tower is set up as the equipment for lifting and lowering drill pipes for boring the seafloor and casing pipes to be inserted as the reinforcing materials into a borehole. The drill pipes in an oil well are piled up generally in a place (pipe storage space) which is apart from the tower. Every time an oil digging operation is started, the drill pipes are transferred from the pipe storage space to the interior of the tower.

To insert a drill pipe into the well center or a mousehole provided in the tower, it is necessary that the drill pipe be suspended vertically. To meet this requirement in a conventional apparatus of this kind, a drill pipe is suspended at one end portion thereof from a suspension means such as a crane and carried from a pipe storage space to the interior of the tower. However, when a drill pipe is transported as it is suspended at one end portion thereof, the pipe is shaken by waves and wind. Consequently, the drill pipe may strike the tower or fall, causing a major accident. To prevent such an accident, much labor is required to hold the pipe firmly, so that the oil drilling operation cannot be carried out in the desired manner.

There is a known apparatus shown in FIGS. 8 and 9, which is designed to carry out pipe lifting and lowering operations speedily and easily. Referring to the drawings, reference numeral 1 denotes guide rails set up on a floor surface within a floating oil drilling tower; and 3 and 4, carriages supported on the guide rails 1 so that the carriages can be moved up and down therealong. A suspension member 6 for a drill pipe 5 is provided on the lower carriage 4 via a parallel link 7 and a driving cylinder 8 so that the suspension member can be moved freely in the horizontal direction. An elevator hand 9 for clamping an upper end portion of the drill pipe 5 during a pipe lifting and lowering operation, or a lathe dog 10 for applying the rotary force to the drill pipe 5 during an oil drilling operation is attached exchangeably to the suspension member 6.

A main frame 12 having a heaving compensator (displacement-absorbing member) 11, which is adapted to suspend the suspension member 6 while absorbing the vertical displacement thereof, is provided on the upper carriage 3 via a parallel link 13 and a driving cylinder 14 so that the main frame 12 can be moved freely in the horizontal direction in a manner similar to the suspension member 6. This main frame 12 is suspended from a suspension cable 15, which is extended thereto from above, such that the main frame can be moved up and down. In a left unit thus constructed, the suspension member 6 and main frame 12 can be displaced in the horizontal direction. Accordingly, even when the drill pipe 5 is positioned in the well center or on the axis of a well 16, the suspension member 6 can be moved up and down without interfering therewith. This enables the pipe lifting or lowering operation to be carried out speedily and easily, and the pipe lifting and lowering cycle time to be reduced.

However, in this conventional apparatus, the suspension member 6 and main frame 12 are provided independently on two carriages 4 and 3, respectively, so that the suspension member 6 and main frame 12 must be moved synchronously in the horizontal direction. Therefore, it is difficult to operate the suspension member 6 and main frame 12. There is the possibility that these parts are operated erroneously to cause them to interfere with each other. Consequently, the ropes 17 in the heaving compensator 11 or a connecting means (not shown), by which the suspension member 6 and the main frame 12 are connected together, would be damaged during the pipe lifting and lowering operations.

A so-called pipe lifting operation is carried out in which a drill string inserted in a well being dug is withdrawn therefrom for the replacement of bits attached to the lowermost portions of the drill pipes. The drill string comprises bits, a plurality of drill collars connected to the bits and a great number of drill pipes connected to the upperemost portions of the drill collars. The drill string is divided into parts (so-called stand pipes) each of which has three connected drill pipes to constitute a unit object material in a pipe lifting operation. The stand pipes are stored in a standing state on the floor surface of the tower which is on the oil drilling rig. In the case of a 6000-meter class drill string, 220 pieces or so of stand pipes have to be housed in the tower. After a bit-replacing operation has been completed, these stand pipes are to be connected successively and lowered into the well. It is necessary, especially, on a marine rig that the stand pipes be supported so as to prevent them from falling due to the rolling of the rig. Therefore, the stand pipes must be stored within the tower reliably in good order. To meet these requirements, a pipe rack device shown in FIG. 10 has been provided. Referring to the drawing, reference numeral 18 denotes pipe storage grooves into which stand pipes 19 are slid diametrically so as to be housed therein. The plural pipe storage grooves 18 are formed in parallel with one another, and have entrances 20 on the same side thereof. Each of the pipe storage grooves 18 is provided therein with a plurality of flexible gates 21 which are spaced in the lengthwise direction of the groove 18 and adapted to support the stand pipes 19. The pipe storage grooves 18 are a groove for housing stand pipes 19' of drill collars, and grooves for housing stand pipes 19'' of drill pipes.

There is a certain type of drill collar which is provided with a deviation-preventing stabilizer, and such a stabilizer-carrying drill collar is connected to a regular drill collar as the former is spaced suitably from the latter.

In the conventional pipe handling apparatus, the stand pipes 19' of drill collars are stored in the same pipe storage groove 18 as mentioned above. Accordingly, it is necessary that the stand pipes 19' be always taken out during a pipe lowering operation in the order which is opposite to the order in which the stand pipes 19' were stored. Hence, it is impossible to take out an arbitrary stand pipe selectively for the purpose of varying the arrangement of the stabilizer-carrying drill collars.

A stand pipe transfer unit is used as means for carrying a stand pipe from a rack to an oil well or vice versa during pipe lifting and lowering operations. This transfer unit comprises, generally, an upper hand for clamping an upper portion of a stand pipe and a lower hand for clamping a lower portion thereof.

However, in the conventional stand pipe tranfer unit, a lower hand 22 is formed so as to extend at right angles to the storage grooves 18 in a rack 23, and has a one-side-openable hand member 24 which opens on the side, as shown in FIG. 11. Therefore, the operation of the transfer unit is so limited that it necessarily transfers such stand pipes first that are housed in a front storage groove 18, and thereafter the stand pipes housed in a rear storage groove adjacent thereto. Moreover, since the stand pipe transfer unit must be rendered usable for transferring the stand pipes in the left and right racks 23 and 23', the hand member 24 must be changed from a rightward-openable hand member to a leftward-openable hand member or vice versa so as to prevent the hand member 24 from interfering with a stand pipe in a pipe storage groove. Hence, the pipe transfer unit cannot be operated easily.

The present invention was made with a view to eliminating the above-mentioned drawbacks encountered in the prior art pipe handling apparatus. An object of the present invention is to provide a pipe handling apparatus for oil drilling operations, which is capable of handling pipes speedily and easily with little labor, and improving the safety of pipe lifting and lowering operations and oil productivity.

According to the present invention, a short-pipe transfer unit for transferring a short pipe between a pipe storage space and an oil well center, a lift unit for vertically displacing the transferred short pipe, a stand-pipe rack unit for holding in a standing state a stand pipe consisting of a plurality of connected short pipes and withdrawn from the oil well and a stand-pipe transfer unit for transferring a stand pipe between the stand-pipe rack unit and the oil well center are improved, respectively, and combined unitarily and operatively so as to achieve the above-mentioned object. An apparatus according to the present invention comprises a short pipe transfer unit having guide rails extending from a pipe storage space, in which short pipes comprising drill pipes and drill collars are stored, to a position above the oil well center, and a carriage on said guide rails so as to transfer said short pipes; a pipe lift unit having a suspension member suspended from a cable via a displacement-absorbing member above said oil well center so that said suspension member can be moved vertically and horizontally, said pipe lift unit being adapted to lift and lower a short pipe from and into said oil well center; a stand pipe rack unit having a plurality of storage grooves for holding therein in a standing state stand pipes each of which has been withdrawn from said oil well center and comprises a plurality of short pipes, and storage chambers formed at entrance portions of said storage grooves and adapted to hold therein said stand pipes each of which comprises drill collars; and a stand pipe transfer unit having a post provided movably between said stand pipe rack unit and said oil well center, and hands on said post and adapted to clamp the upper and lower ends of said stand pipe.

A preferred embodiment of the present invention will now be described with reference to the accompanying drawings.

DETAILED DESCRIPTION OF THE PREFERRED EMBODIMENT

Figure 1:
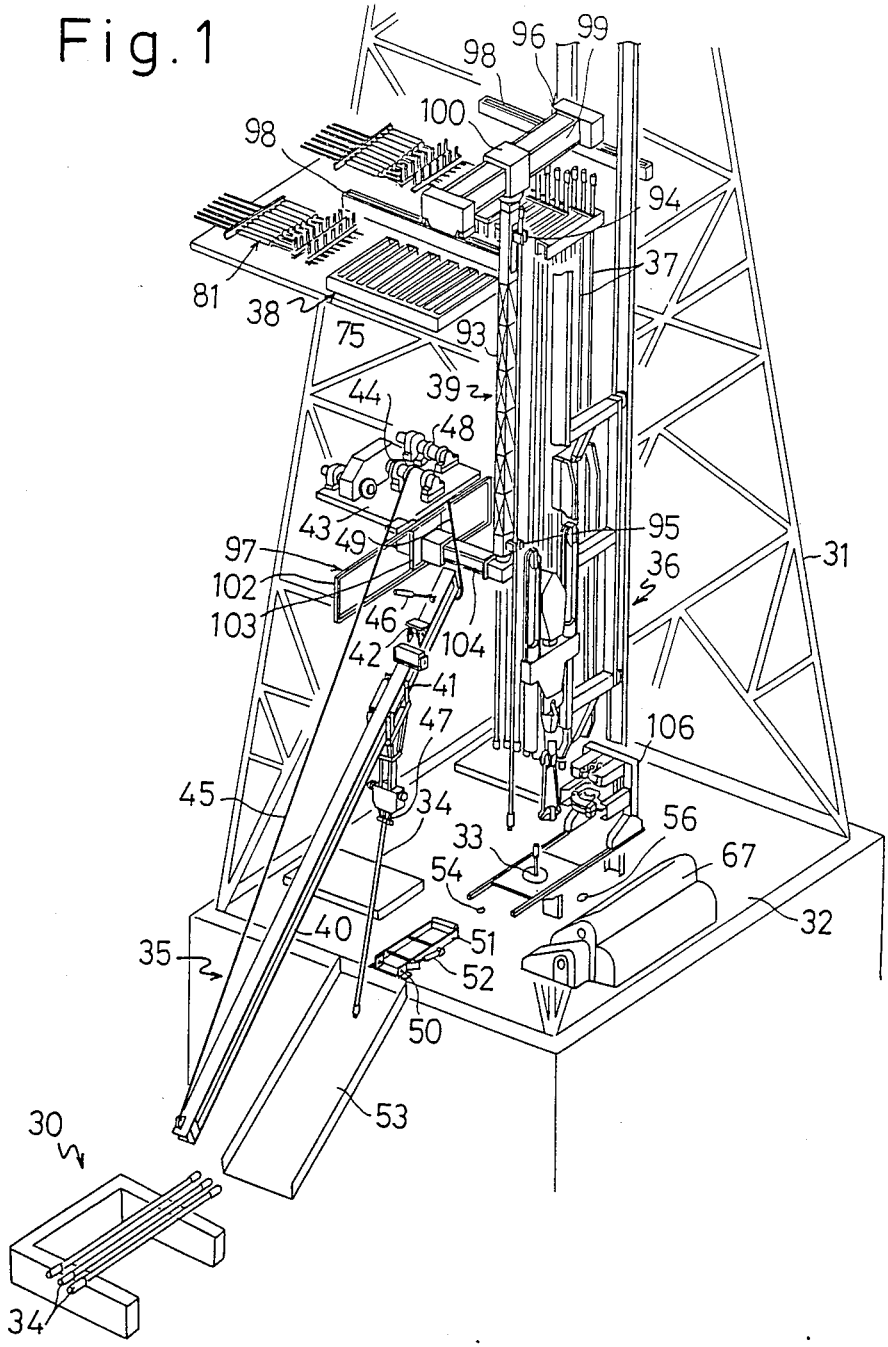
FIG. 1 is a perspective view of an embodiment of the apparatus according to the present invention.

As shown in FIG. 1, the pipe handling apparatus according to the present invention comprises a short-pipe transfer unit 35 adapted to transfer a short pipe 34 between a pipe storage space 30 and the oil well center 33 on a floor surface 32 within a tower 31; a lift unit 36 adapted to vertically displace the transferred short pipe 34 from and into the oil well center 33, a stand-pipe rack unit 38 adapted to hold therein in a standing state stand pipes 37 each of which has been withdrawn from the oil well center 33 and consists of a plurality of linearly-connected short pipes; and a stand-pipe transfer unit 39 adapted to transfer a stand pipe 37 between the stand pipe rack unit 38 and oil well center 33. These constituent parts will now be described individually in detail.

First, the short-pipe transfer unit 35 comprises a guide rail 40 extending from the pipe storage space 30 to a position above the oil well center 33 and a carriage 41 disposed movably on the guide rail 40 and adapted to transfer the short pipe 34. The guide rail 40 is formed linearly and supported pivotably via a hinge 42 such that one end of the guide rail 40 fronts on the pipe storage space 30 with the other end thereof fronting on the oil well center 33 so as to prevent the guide rail 40 from interfering with other parts. To pivotally move the guide rail 40, a guide rail operating winch 44 is disposed via a table 43 on the tower 31 above the guide rail 40. A preceding end of a cable 45 uncoiled from the winch 44 is fixed to the end of the guide rail which is adjacent to the pipe storage space 30. The guide rail 40 is used as the end thereof which is adjacent to the pipe storage space extends downward. A hinge cylinder 46 is disposed between and joined to the upper end of the guide rail 40 and the tower 31 so as to prevent the guide rail 40 from being swung when the carriage 41 moves thereon. The carriage 41 has a chucking unit 47 suspended therefrom, the chucking unit 47 being adapted to clamp one end of the short pipe 34. The chucking unit 47 is swingable in such a manner that the short pipe 34 may be inserted into the oil well center 33 even when the carriage 41 is not just above the oil well center 33.

A carriage driving winch 48 is disposed on the table 43 so as to move the carriage 41. A preceding end of a cable 49 uncoiled from the winch 48 is fixed to the carriage 41 via an upper end portion of the guide rail 40.

A swing arm 51 is disposed via a hinge 50 on an edge portion, which is below the guide rail 40, of the floor surface 32 so that the swing arm 51 can be moved pivotally in an upwardly-directed state in the direction in which the short pipe 34 is transferred. A swing cylinder 52 is disposed between and fixed to the swing arm 51 and the floor surface 32. This swing arm 51 is adapted to prevent the short pipe 34 from being swung toward the oil well center 33 when the short pipe 34 has passed a ramp way 53 extending between the floor surface 32 and pipe storage space 30. The swing arm 51 is retained in an uprightly-extending state in advance and operated so as to fall slowly after it has received the short pipe 34.

Figure 2:
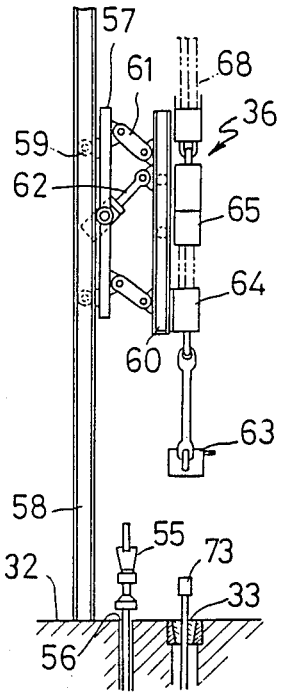
FIG. 2 is a side elevation of a pipe lift unit in the embodiment of the present invention.

A mousehole 54 for temporarily housing the short pipe 34, and a rathole 56 for housing a drill pipe-turning lathe dog 55 as shown in FIG. 2 are formed in the vicinity of the oil well center 33. The short pipe 34 transferred by the carriage 41 is inserted into the oil well center 33 or the mousehole 54.

Figure 3:
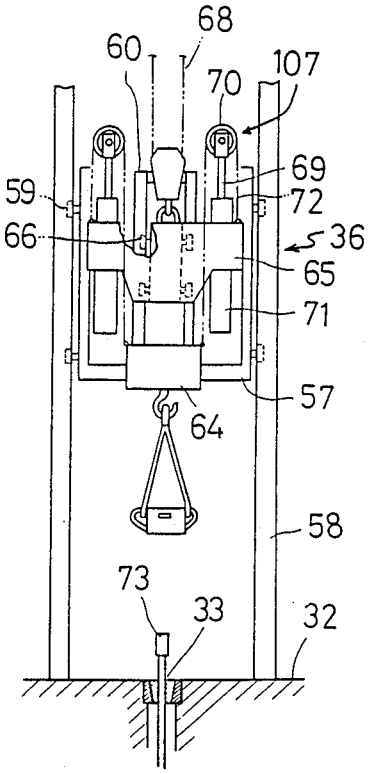
FIG. 3 is a front elevation of FIG. 2.

The lift unit 36 has main rails 58 as shown in FIGS. 2 and 3 which are set up on the floor surface 32 so as to guide a main carriage 57 such that the carriage 57 can be moved up and down along an extension line of the oil well center 33.

The main rails 58 comprises a pair of steel channels which are set up in parallel with each other as they are spaced from each other by a predetermined distance. The main rails 58 support the main carriage 57 so that the carriage 57 can be moved up and down, with the wheels 59 at the four corners of the main carriage 57 engaged with corresponding grooves in the main rails 58. Auxiliary rails 60, which are parallel to the main rails 58, are provided via parallel links 61 on the main carriage 57 so that the auxiliary rails 60 are moved horizontally, along a line connecting the oil well center 33 and rathole 56 together. A driving cylinder 62 for moving the auxiliary rails 60 in the horizontal direction is provided between the main and auxiliary rails 58 and 60 and joined thereto. A suspension member 64 for suspending an elevator hand 63 or lathe dog 55 is fixed to the lower end portions of the auxiliary rails 60, and an auxiliary carriage 65 constituting a main frame is supported on the auxiliary rails 60 so that the carriage 65 can be vertically moved. The auxiliary rails 60 comprises a pair of steel channels arranged in parallel with each other and spaced from each other by a distance smaller than the distance between the main rails 58. Wheels 66 on the auxiliary carriage 65 are engaged with corresponding grooves in the auxiliary rails 60 to vertically movably support the auxiliary carriage 65. The auxiliary carriage 65 is suspended from a suspension cable 68 one end of which is wound in draw works 67 serving as a winch, so that the auxiliary carriage 65 can be moved up and down. The auxiliary carriage 65 is provided thereon with a displacement-absorbing member (heaving compensator) 107 which suspends the suspension member 64 and which is adapted to absorb the displacement occurring between the auxiliary carriage 65 and suspension member 64. This heaving compensator 107 comprises cylinders 71 provided at both side portions of the auxiliary carriage 65 and having pulleys 70 at the free end portions of upwardly-extending piston rods 69, and ropes 72 wrapped around the pulleys 70 and connected at one end of each thereof to the auxiliary carriage 65 and at the other end of each thereof to the suspension member 64. A predetermined level of fluid pressure (hydraulic pressure) is applied to the cylinders 71 so as to suspend a drill pipe (consisting of a plurality of series-connected drill pipes) 73 via the suspension member 64. Namely, the heaving compensator 107 is so constructed that, when the suspension member 64 receives the upward or downward force from the drill pipe 73 due to the vibration of the tower, the heaving compensator 107 can absorb or repel such force, and protect the drill pipe 73 and control a bit load suitably.

Figure 4:
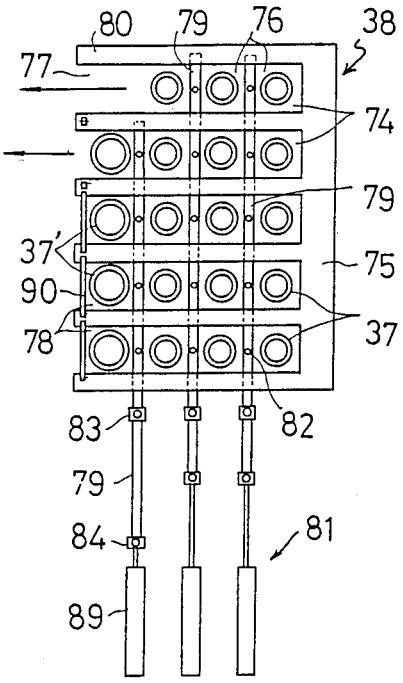
FIG. 4 is a plan view of a stand-pipe rack unit in the apparatus according to the present invention.

The stand pipe rack unit 38 comprises as shown in FIG. 4 a comb-shaped rack body 75 having a plurality of pipe storage grooves 74. In each of the pipe storage grooves 74, a plurality (three in the example shown in the drawing) of storage chambers, in which stand pipes 37 each comprising drill pipes are held, are formed successively in the lengthwise direction thereof. At an entrance portion 77 of each pipe storage groove 74, a storage chamber 78 in which a stand pipe 37' comprising drill collars is held is formed.

Figure 5:
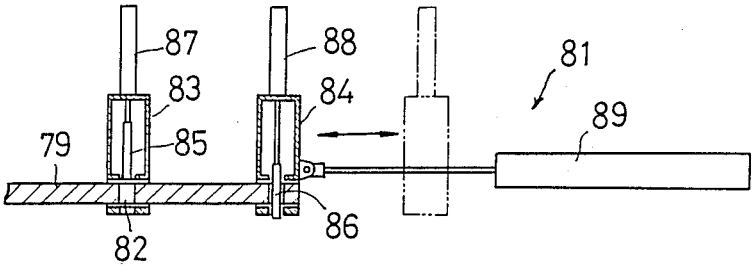
FIG. 5 is an enlarged and partial sectional view of FIG. 4.

The rack body 75 is provided with rod type partition gates 79 in all of the pipe storage grooves 74 so that the partition gates 79 extend detachably across the storage grooves 74, whereby each groove 74 is divided into a plurality of drill pipe storage chambers in each of which one drill pipe is held. Bores (not shown), through which the partition gates 79 are inserted at right angles to comb-shaped frame portion 80 of the rack body 75, are formed therein. Means 81 for slidingly moving the partition gates 79 are provided at one side of paths along which the partition gates 79 are moved. To move the partition gates 79 at a predetermined rate by these means 81, each partition gate 79 is provided with pin bores 82, which serve as locking bores and which are spaced from each other by a distance equal to the distance between the axes of two adjacent pipe storage grooves 74. The partition gate driving means 81 is provided in the vicinity of the outer side of the rack body 75 as shown in FIG. 5, and comprises a stopper 83 for stopping the movement of the partition gate 79 intermittently, and an operating member 84 provided on the outer side of the stopper 83 and adapted to move the partition gate 79 intermittently at a predetermined rate. The stopper 83 and operating member 84 have pins 85 and 86, respectively, which are to be withdrawably inserted into the pin bores 82 in the partition gate 79. The pins 85 and 86 are provided with cylinders 87 and 88, respectively, which are used to insert and withdraw the pins 85 and 86 into and from the pin bores 82. The operating member 84 is further provided with an operating cylinder 89 for moving the operating member 84 horizontally at a predetermined rate.

Figure 6:
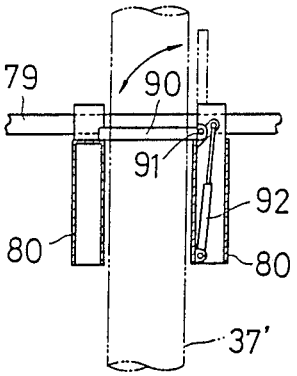
FIG. 6 is an enlarged sectional view of a pipe storage unit.

At the open end of each of the drill collar storage chambers 76, a pivotable gate 90 for individually and selectively opening the chamber 76 is provided. The gate 90 is supported at its base end on a tooth member of the comb-shaped frame portion 80 via a pivot 91 as shown in FIG. 6, and extends at its free end over the adjacent tooth member of the frame portion 80. The pivotable gate 90 is further provided at its base end with a cylinder 92 as means for swinging the free end of the gate 90 about the pivot 91.

Figure 7:
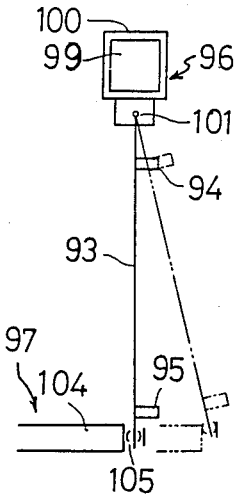
FIG. 7 is a schematic side elevation of a stand-pipe transfer unit in the apparatus according to the present invention.
Figure 8:
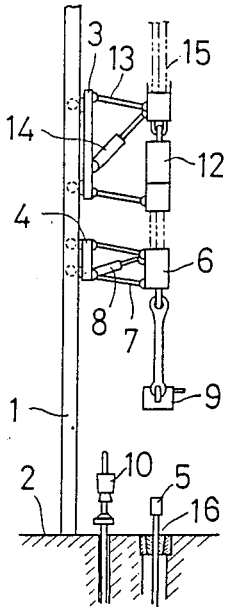
Fig. 8 PRIOR ART
FIG. 8 is a side elevation of a pipe lift unit in a conventional apparatus of this kind.
Figure 9:
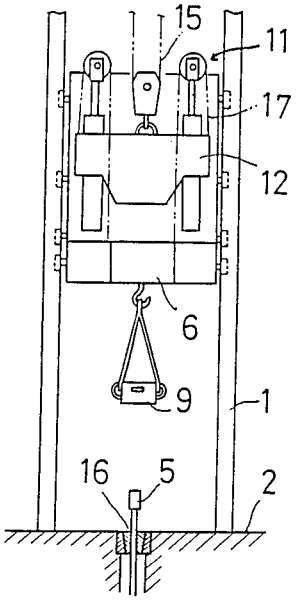
Fig. 9 PRIOR ART
FIG. 9 is a front elevation of FIG. 8.
Figure 10:
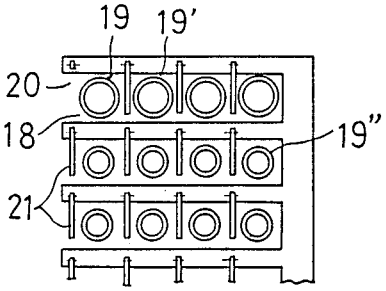
Fig. 10 PRIOR ART
FIG. 10 is a plan view of a pipe rack in the conventional apparatus.
Figure 11:
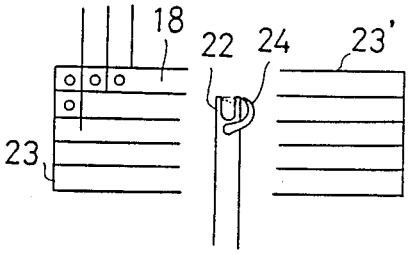
Fig. 11 PRIOR ART
FIG. 11 is a schematic diagram showing the relation between pipe racks and a hand in the conventional apparatus.

As shown in FIGS. 1 and 7, the stand pipe transfer unit 39 has a post 93 which is adapted to be moved between the stand pipe rack unit 38 and the oil well center 33. This post 93 is provided with a pair of hands 94 and 95 which are adapted to clamp the upper and lower ends of the stand pipe 37. Especially, the upper hand 94 is so formed as to be moved up and down along the post 93 for regulation of the height of the stand pipe 37 in the oil well center 33.

The post 93 is further provided at its upper and lower ends with manipulators 96 and 97, respectively, as means for moving the post 93. The upper manipulator 96 comprises a girder 99 supported movably on the tower 31 via horizontal rails 98, and a carriage 100 supported on the girder 99 for horizontal movement. The horizontally movable carriage 100 is joined at its bottom to an upper end of the post 93 via a turning member (not shown) and a universal joint 101. The lower manipulator 97 comprises a carriage 103 supported on the tower 31 via a support rail 102 for horizontal movement, and a retractable arm 104 provided on the carriage 103 for extension from and retraction into the carriage 103 in the direction which is the same as the direction in which the girder 99 moves. The lower end of the post 93 is connected to the front end of the retractable arm 104 via a spherical joint 105 which can be slid in the vertical direction.

The upper and lower manipulators 96 and 97 are adapted to be controlled synchronously. The post 93 has a tower-like construction, the outer diameter of which is smaller than the inner diameter of a pipe storage groove 74 in the rack body. Accordingly, the post 93 can be moved into the pipe storage groove 74, and wind load can be minimized.

Reference numeral 106 in FIG. 1 denotes a short pipe connecting rotary unit. The rotary unit 106 is disposed on the floor surface 32 and is movable in the direction interconnecting the oil well center 33 and the mousehole 54. The unit 106 serves for clamping the lathe dog 55 to transport it above the mousehole 54 for connection thereof with short pipe 34 in the mousehole 54 when the short pipe 34 in the mousehole 54 is to be transferred to the oil well center 33 for interconnection of the pipes 34.

The operation of the embodiment will now be described.

When the cable 49 is wound off from the carriage-driving winch 48, the carriage 41 in the short pipe transfer unit 35 moves down by its own weight along the guide rails 40 and reaches the pipe storage space 30 where it clamps one end of a short pipe 34 by its chucking unit 47. When the cable 49 is then taken up around the winch 48, the carriage 41 moves up along the guide rails 40 to thus transfer the short pipe 34 from the pipe storage space 30 to the oil well center 33. This enables the transporting of the short pipe 34 from the pipe storage space 30 to the oil well center 33 to be done speedily and safely. To return the short pipe 34 from the oil well center 33 to the pipe storage space 30, the above operations are carried out in reverse order.

The short pipes 34, i.e. drill pipes transferred to the oil well center 33 are connected at their opposed ends successively and lowered into the oil well center 33 as the connected pipes are turned so as to drill the ground. This pipe lowering operation and a pipe lifting operation for the replacement of bits are carried out by the pipe lift unit 36.

The load of the main carriage 57 which constitutes the pipe lift unit 36 is transmitted to and borne by the suspension cable 68 via the parallel links 61, auxiliary rails 60, suspension member 64, heaving compensator 107 and auxiliary carriage 65. Accordingly, the main carriage 57 moves up and down with the suspension member 64 by the operation of the suspention cable 68. Therefore, when the suspension member 64 receives the upward force from the drill pipe 73 due to the shaking of the tower, the heaving compensator 107 absorbs the displacement of the suspension member 64, which occurs due to the upward force, while suspending the suspension member 64. As a result, the main carriage 57 moves upward by a distance corresponding to the level of displacement absorbed by the heaving compensator 107. During this time, the auxiliary carriage 65 causes the auxiliary rails 60 to be moved upward in accordance with the upward movement of the main carriage 57.

The suspension member 64 and auxiliary carriage 65 which constitutes a main frame are arranged on the same auxiliary rails 60 so as to be moved unitarily in the horizontal direction via the parallel links 61 in accordance with the movement of the main carriage 57. Therefore, unlike a conventional apparatus of this kind, it is unnecessary to synchronize the movements of the main frame and suspension member. Namely, the auxiliary carriage 65 and suspension member 64 can be moved easily in the horizontal direction by merely operating the sole driving cylinder 62, and the auxiliary carriage 65 and suspension member 64 do not interfere with each other. This enables the durability and safety of the apparatus to be improved. The stand pipe 37 lifted by the pipe lift unit 36 is then stored in the stand pipe rack unit 38.

To start a pipe lifting operation, all the gates 79 and 90 in the stand pipe rack unit 38 are opened so as to set the pipe storage grooves 74 ready to receive stand pipes 37. To open a partition gate 79, the pin 86 in the operating member 84 is inserted into the pin bore 82 in the gate 79, and the pin 85 in the stopper 83 is withdrawn from the pin bore 84, as shown in FIG. 5. The operating member 84 is then moved one step by operating the cylinder 89. The pin 85 in the stopper 83 is then inserted into the pin bore 82, and the pin 86 in the operating member 84 is withdrawn from the pin bore 82. The operating member 84 is then moved toward the stopper to carry out the withdrawing and inserting of the pins 85 and 86 again. These operations are repeated, so that the partition gate 79 is moved slidingly in increments to be opened. Since the partition gate 79 is always fixed by either of the pins 85 and 86, it is not opened uselessly by the swinging movement of the floating body; the partition gate 79 is operated safely.

To open a pivotable gate 90, the gate-pivoting cylinder 92 is contracted. Consequently, the gate 90 is moved pivotally and opened, as shown in phantom in FIG. 6.

First, the stand pipes 37 each of which comprises stand pipes are lifted and inserted into the innermost portion of a pipe storage groove 74 toward the entance portion thereof in order. During this time, a partition gate 79 is closed as a stand pipe 37 is inserted into a pipe storage groove 74, so to store one stand pipe 37 in one storage chamber 76 successively. To close the partition gate 79, the partition gate-opening operation described above is reversed.

After all the stand pipes 37 each of which comprises drill pipes have been stored in the storage grooves 74, the storing of stand pipes 37′ to be then lifted each of which comprises drill collars is then done. The storing of the stand pipes 37′ is done so that one stand pipe 37′ is held in one pipe storage chamber 78 formed at the entrance portion 77 of each pipe storage grooves 74. After a stand pipe 37′ has been inserted into a storage chamber 78, the relative pivotable gate 90 is closed. The stand pipes 37' are housed in the storage chambers 78 successively in the above-mentioned order.

A pipe lowering operation may be carried out in the order which is the reverse of the above-mentioned order. Especially, during a pipe lowering operation, an arbitrary stand pipe 37' can be taken out selectively since the stand pipe 37', which comprises drill collars, is housed in the storage chamber 78 at the entrance portion of a pipe storage groove, with the storage chamber 78 closed individually with the pivotable gate 90. Thus, the re-connecting of the stand pipes 37', in which stabilizers are arranged suitably, can be done smoothly.

Since the drill pipe storage chambers 76 are separated from the adjacent storage chamber 78 by a common partition gate 79, the construction of the stand pipe rack unit can be simplified unlike the stand pipe rack unit in a conventional apparatus of this kind in which the storage chambers are separated from the adjacent storage chambers by pivotable gates. This enables the dimensions and manufacturing cost of a pipe handling apparatus to be reduced greatly.

When the stand pipes 37 and 37' withdrawn from the oil well center 33 are transferred to the stand pipe rack unit 38, and when the stand pipes 37 and 37' are transferred from the stand pipe rack unit 38 so as to be lowered into the oil well center 33, the stand pipe transfer unit 39 is operated. For example, in order to transfer a stand pipe 37 stored in the stand pipe rack unit 38, it is clamped by the upper and lower hands 94 and 95, and the upper and lower manipulators 96 and 97 are operated simultaneously, so that the stand pipe 37 is transferred to the oil well center 33. During this time, the load of the stand pipe is supported by the upper hand 94; and only the horizontal load imparted to the stand pipe 37, by the lower hand 95. Especially, since the upper and lower hands 94 and 95 are provided on the common, rotatable post 93, the hands 94 and 95 can be positioned opposite to the stand pipe 37 so as to clamp it freely. Consequently, the hands 94 and 95 need not to be replaced with differenct hands when stand pipes 37 are taken out from the left and right rack bodies 75. Since the upper and lower hands are turned unitarily, the unreasonable force such as the torsional force is not imparted to the stand pipe 37.

The mast 93 is suspended swingably from the upper manipulator 96 via the universal joint 101. Therefore, even when a synchronizing error occurs between the upper and lower manipulators 96 and 97, it can be absorbed by the post 93 as the post 93 moves pivotally. This decreases the turnover moment imparted to the upper manipulator 96.

Since the short pipe transfer unit 35, pipe lift unit 36, stand pipe rack unit 38 and stand pipe transfer unit 39 are combined operatively, continuous and automatic mechanization of the pipe handling can be achieved, and labor can be saved. Also, the safety and speed of pipe lifting and lowering operations as well as the oil productivity can be improved.

The present invention described above has the following excellent effects. (1) The short pipes can be transferred automatically and consistently between the pipe storage space and the oil well center by the short pipe transfer unit. The interference of the suspension member with other parts can be prevented by the pipe lift unit. A stand pipe comprising drill collars can be taken out arbitrarily owing to the specially constructed stand pipe rack unit. Moreover, since the stand pipe transfer unit has novel parts, the replacement of the hands can be omitted so that the pipe handling can be done speedily and easily. (2) In this way the productivity can be improved, and labor can be saved. Also, the safety of the pipe lifting and lowering operations can be improved. (3) In the short pipe transfer unit according to the present invention, the upper end of the post is connected to the upper manipulator through the turning means and the universal joint and the lower end of the manipulator is connected to the lower manipulator through the vertically slidable spherical joint, the upper and lower manipulators being operated synchronously. As a result, the post is movable in front and rear and right and left and turnable. The post is provided at its upper and lower ends with a pair of hands for clamping the upper and lower end of the stand pipe, the hands being turnable in unison with the post. As a result, unreasonable force such as torsional force is not imparted to the stand pipe clamped by the hands and the stand pipe can be easily clamped out from the right and left rack bodies with no need of exchanging the hands. Moreover, the post is swingably suspended through the universal joint from the upper manipulator and is slidably connected through the sperical joint to the lower manipulator so that any differential in synchronism between the upper and lower manipulator can be absorbed by the post being titled, whereby the turnover movement imparted to the upper manipulator can be reduced. (4) The swing arm is provided for prevention of the short pipe from swinging toward the oil well center when the short pipe is being transported above the floor surface along the guide rail of the short pipe transfer unit. Thus, the short pipe can be smoothly transported without swinging.

What is claimed is:

1. A pipe handling apparatus for oil drilling operations and the like, comprising a short pipe transfer unit (35) having a guide rail (40) extending from a pipe storage space (30), in which short pipes (34) comprising drill pipes and drill collars are stored, to a position above an oil well center (33), and a carriage (41) on said guide rail (40) so as to transfer said short pipes (34), said carriage (41) having a chucking unit (47) adapted to chuck said short pipe (34); a pipe lift unit (36) having a suspension member (64) suspended from a suspension cable (68) via a displacement-absorbing member (107) above said oil well center (33) so that said suspension member (64) can be moved vertically and horizontally, said pipe lift unit (36) being adapted to lift and lower the short pipe (34) from and into said oil well center (33); a stand pipe rack unit (38) having a plurality of storage grooves (74) for holding therein, in a standing state stand pipes (37) each of which has been withdrawn from said oil well center (33) and comprises a plurality of series-connected short pipes (34), and storage chambers (78) formed at entrance portions (77) of said storage grooves (74) and adapted to hold therein stand pipes (37') each of which comprises drill collars; a stand pipe transfer unit (39) having a post (93) between said stand pipe rack unit (38) and said oil well center (33), said post (93) having an upper end connected to an upper manipulator (96) through turning means and a universal joint (101) and a lower end connected to a lower manipulator (97) through a vertically slidable spherical joint (105) whereby the post (93) is swingable in front and rear and right and left, said post (93) further having at its upper and lower ends a pair of upper and lower hands (94) and (95) secured thereto and adapted to respectively clamp upper and lower ends of the stand pipe (37), whereby the hands (94) and (95) are turnable in unison with the post (93); a swing arm (51) on a floor surface (32), on which said oil well center (33) is disposed, adapted to fall for prevention of the short pipe from being swung during transportation thereof along the guide rail (40); and a short pipe connecting rotary unit (106) which is displaceable.

2. An apparatus according to claim 1, wherein said upper manipulator (96) comprises a girder (99) supported movably on a tower (31) via horizontal rails (98) and a carriage (100) supported on the girder (99) for horizontal movement, said lower manipulator (97) comprising a carriage (103) supported on the tower (31) via a support rail (102) for horizontal movement and a retractable arm (104) on the carriage (103) for extension from and retraction into the carriage (103) in a direction which is the same as a direction of movement of the girder (99), the upper end of the post (93) being connected through the turning means and the universal joint (101) to a bottom of the carriage (100), the lower end of the post (93) being connected to a tip end of the arm (104).

* * * * *